US009096077B2

(12) United States Patent
Yamaura

(10) Patent No.: US 9,096,077 B2
(45) Date of Patent: Aug. 4, 2015

(54) INKJET PRINTING APPARATUS FOR PRINTING MESH-LIKE MEDIUM

(75) Inventor: Tsukasa Yamaura, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/113,380

(22) PCT Filed: May 2, 2012

(86) PCT No.: PCT/JP2012/061604

§ 371 (c)(1),
(2), (4) Date: Oct. 23, 2013

(87) PCT Pub. No.: WO2012/153694

PCT Pub. Date: Nov. 15, 2012

(65) Prior Publication Data

US 2014/0043418 A1 Feb. 13, 2014

(30) Foreign Application Priority Data

May 6, 2011 (JP) ..... 2011-103753

(51) Int. Cl.

| | |
|---|---|
| ***B41J 2/01*** | (2006.01) |
| ***B41J 11/00*** | (2006.01) |
| ***B41J 3/407*** | (2006.01) |
| ***B41J 11/06*** | (2006.01) |

(52) U.S. Cl.

CPC ..... *B41J 11/0015* (2013.01); *B41J 3/4078* (2013.01); *B41J 11/002* (2013.01); *B41J 11/06* (2013.01)

(58) Field of Classification Search

USPC ..... 347/102, 101, 104

See application file for complete search history.

(56) References Cited

U.S. PATENT DOCUMENTS 6,116,728 A * 9/2000 Miyake et al. ..... 347/102
6,183,146 B1 * 2/2001 Kusunoki ..... 396/579

(Continued)

FOREIGN PATENT DOCUMENTS

| | | |
|---|---|---|
| JP | 05-042670 | 2/1993 |
| JP | 09-133464 | 5/1997 |
| JP | 2001-30519 | 2/2001 |
| JP | 2006-265813 | 10/2006 |

OTHER PUBLICATIONS

"International Search Report (Form PCT/ISA/210)", mailed on Jun. 5, 2012, with English translation thereof, p. 1-p. 5, in which the listed references (JP09-133464 and JP2001-30519) were cited.

(Continued)

*Primary Examiner* — Henok Legesse
(74) *Attorney, Agent, or Firm* — Jianq Chyun IP Office

(57) ABSTRACT

Provided is an inkjet printing apparatus that can dry a medium immediately after printing or bleed-through ink while preventing the medium or bleed-through ink from being in contact with a dryer. In an inkjet printing apparatus including an inkjet head (20) for discharging ink onto a mesh-like media (10) having through holes penetrating from the top surface, which is the printing surface, to the bottom surface, a feeder (12) for feeding the mesh-like medium (10) in a feed direction, and a dryer for drying the mesh-like medium (10) hit by ink discharged from the ink-jet head (20), the dryer has a blower (28) placed under the mesh-like medium 10) for applying an air flow to the bottom surface of the mesh-like medium (10) with the top surface hit by the ink.

6 Claims, 2 Drawing Sheets

(56) References Cited

U.S. PATENT DOCUMENTS

2004/0179077 A1* 9/2004 Samii et al. ..... 347/101
2007/0199206 A1 8/2007 Park et al.

OTHER PUBLICATIONS

"1st Office Action of China Counterpart Application", issued on Oct. 30, 2014, with English translation thereof, p. 1-p. 16.

* cited by examiner

INKJET PRINTING APPARATUS FOR PRINTING MESH-LIKE MEDIUM

CROSS-REFERENCE TO RELATED APPLICATION

This application is a 371 application of an international PCT application ser. no. PCT/JP2012/061604, filed on May 2, 2012, which claims the priority benefit of Japan application no. 2011-103753, filed on May 6, 2011. The entirety of each of the above-mentioned patent applications is hereby incorporated by reference herein and made a part of this specification.

TECHNICAL FIELD

The present invention relates to an inkjet printing device capable of printing to a mesh-like medium.

BACKGROUND ART

A printing apparatus for printing to a material, such as fabric or film, is conventionally known.

As an example of such a printing apparatus, Patent Literature 1 discloses a configuration for forming an image on a fabric. The printing apparatus of the Patent Literature 1 applies a sublimation ink to a fabric as print target while winding the fabric in its longitudinal direction and heats the applied sublimation ink to a predetermined temperature. In this printing apparatus, a preheater having a far-infrared ray lamp is placed under the fabric to which the sublimation ink is applied, and the preheater heats the fabric to dry the sublimation ink.

CITATION LIST

Patent Literature

[Patent Literature 1]: JP-A-2006-265813

SUMMARY OF INVENTION

Technical Problem

Generally, the fabric has a mesh-like structure. And, typically, through holes penetrating from the top surface to the bottom surface of the fabric are formed, although the size of the through hole may vary depending on the material property of the fabric. Furthermore, the through holes may be formed in another medium excepting the fabric.

Thus, in a situation when printing to a medium in which through holes penetrating from the top surface to the bottom surface are formed, after an ink is applied or hit to the top surface, what is called a bleed-through may occur, i.e., the ink may penetrate to the bottom surface through the through hole.

The bleed-through of the ink itself would not be a problem, as far as the bleed-through ink is dried without contact with any other positions.

However, in a configuration in which a drier is provided under the fabric as in the Patent Literature 1, when the bleed-through ink happens to adhere to the dryer, a problem may occur in which the ink further adheres to another positions of the fabric that is in contact with the dryer, thereby spreading contamination over the fabric or the overall apparatus.

In order to solve the above problem, it is an object of the present invention to provide an inkjet printing device that can dry a medium immediately after printing or bleed-through ink, while preventing the medium or the bleed-through ink from being in contact with a dryer.

An inkjet printing device in accordance with the invention includes: an inkjet head for discharging an ink onto a mesh-like medium which has through holes penetrating from a top surface (i.e., printing surface) to a bottom surface; a feeder for feeding the mesh-like medium in a feed direction; and a dryer for drying the mesh-like medium hit by the ink discharged from the inkjet head, wherein the dryer has a blower placed under the mesh-like medium for applying an air flow to the bottom surface of the mesh-like medium with the top surface hit by the ink.

With this configuration, the medium is applied with an air flow sent from the blower below. Due to this, the medium itself receives the upward force of the air flow, which dries the ink while preventing the medium from being in contact with the dryer. Therefore, this prevents the bleed-through ink from adhering to the dryer, which can prevent the medium or the apparatus body from being contaminated.

Furthermore, in the inkjet printing device in accordance with the invention, the blower is preferably placed adjacent to a printing position at which the inkjet head is placed.

According to this configuration, since no other component is placed between the printing position and the blower, the ink can be dried immediately after printing to the medium, which can reduce the possibility that the bleed-through ink is in contact with any positions of the inkjet printing device.

Furthermore, this configuration provides an operation and effect that the medium can be effectively loaded with a tension.

Specifically, conventionally, the medium is loaded with a tension by putting the medium onto a tension bar, and causing the tension bar to pull the medium. The tension bar is typically positioned far from the printing position. However, if the tension bar is too far from the printing position, the tension may be insufficient at the printing position due to the weight of the medium itself and the elongated medium. Furthermore, some medium (especially fabric) may include a portion that can be easily tensioned and a portion that is difficult to be tensioned. When a tension is given to such a medium, non-uniformity in tension occurs in the medium. When the medium is not tensioned or non-uniformity in tension is occurring in the medium at the printing position, a wrinkle or floating may occur in the medium. When any wrinkle or floating occurs in the medium particularly at the printing position, distortion, misalignment, non-uniformity or the like in printing may occur, so it is required that the medium is preferably loaded with a uniform tension at the printing position.

Thus, with the configuration as described above, since the medium is applied with an air flow sent from the blower below at a position very close to the printing position, applying a tension continuously from the printing position prevents the occurrence of misalignment and non-uniformity in the medium, and suppresses distortion in the medium at the printing position, which can stabilize a hitting position of the ink to enhance the printed image quality.

In the inkjet printing device in accordance with the invention, a cover in which a plurality of ventilating holes are formed is preferably provided between the blower and the mesh-like medium.

According to this, an air flow sent from the blower can be distributed over the plurality of ventilating holes of the cover, which can uniformly apply the air flow to the medium.

In the inkjet printing device in accordance with the invention, a heater is preferably provided in the blower so that the blower sends a heated air flow. Furthermore, preferably, a heating temperature of the heater can be adjusted.

According to this, a temperature of the ink is controlled so as not exceeding a sublimation temperature and a reaction temperature, and the ink can be dried more rapidly to a extent of not affecting the printed image quality.

In the inkjet printing device in accordance with the invention, preferably, a platen is provided under the printing position at which the inkjet head is placed, and the platen includes: an ink receiver that is formed concave downward so as to receive the ink which has bled through the mesh-like medium; and an end edge portion formed on a top end on a downstream side of the ink receiver so that the end edge portion is in contact with the bottom surface of the mesh-like medium.

According to this, when is in printing, the bleed-through ink falls into the ink receiver, which can suppress the adhesion of the bleed-through ink to the platen. Furthermore, by using an air flow from the blower under the medium, a contact pressure at which the medium is in contact with the end edge portion of the ink receiver can be reduced. Therefore, the contact pressure of the medium can be reduced for suppressing the occurrence of contamination and preventing the wearing of the end edge portion.

Furthermore, in the inkjet printing device in accordance with the invention, preferably, an amount of the air flow from the blower can be adjusted.

According to this, the drying condition and the tension can be changed depending on the medium type, so an optimum printing condition can be chosen.

According to the inkjet printing device of the invention, the bleed-through ink can be dried without contacting with the dryer, which can prevent the adhesion of contamination to the medium or the apparatus.

FIRST EMBODIMENT

A suitable embodiment of the invention is described with reference to the drawings.

Figure 1:
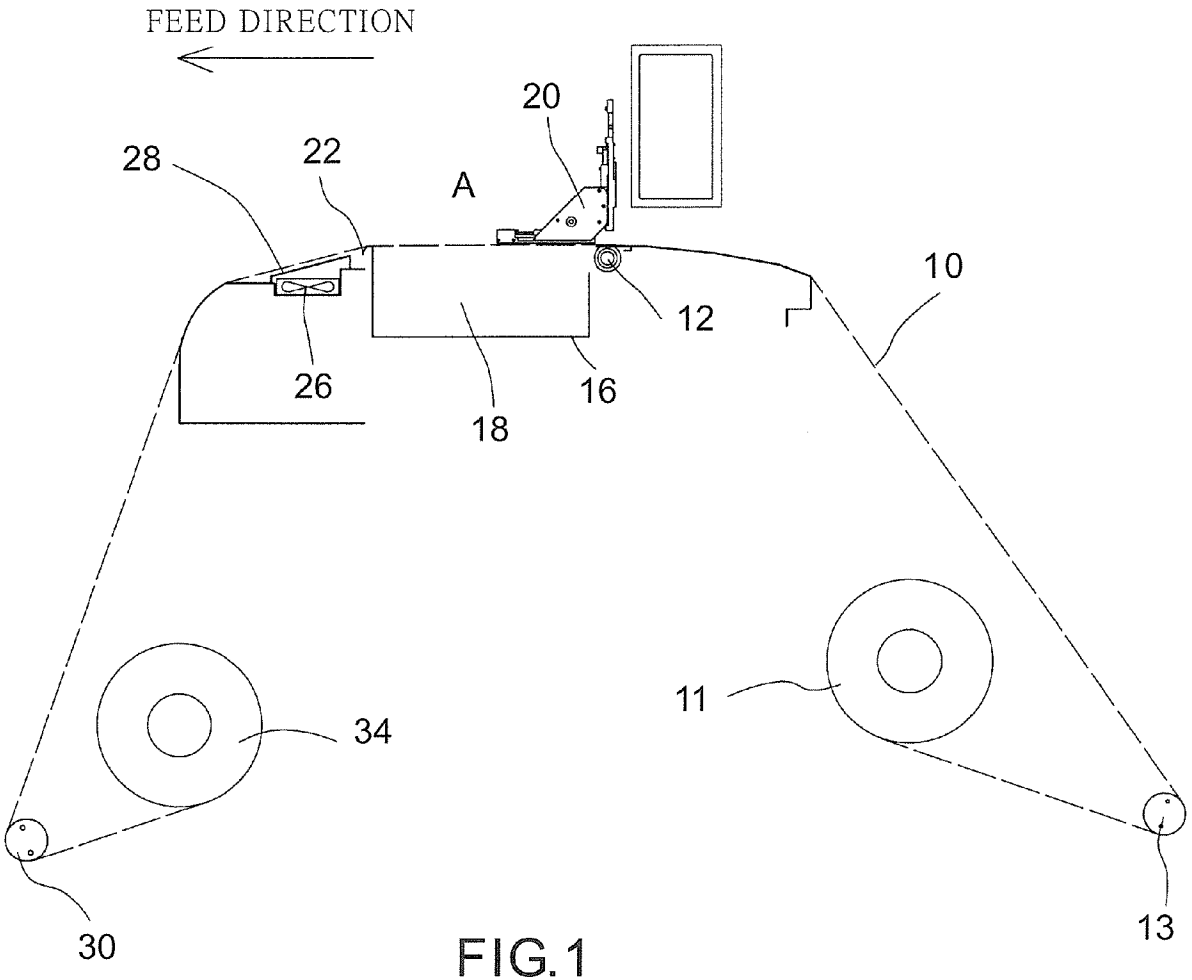
FIG. 1 is a schematic side view of an inkjet printing device in accordance with the invention.

FIG. 1 shows a schematic side view of an inkjet printing device. Referring to FIG. 1, a mesh-like medium 10 having through holes is indicated by a broken line. For example, the medium 10 may be a fabric, a film or the like, but is not limited to them.

In the embodiment, the medium 10 is fed in a direction from right to left in the figure (in an arrow direction in FIG. 1). On the upstream side of the feed direction, the medium 10 is unprinted and wound around a pull roll 11. The medium 10 pulled out from the pull roll 11 is put onto a tensioning bar 13 positioned at a level lower than the pull roll 11 and is given a predetermined tension by the tensioning bar 13.

The medium 10 put onto the tensioning bar 13 is fed to a printing position A at which an inkjet head (which may be hereinafter simply referred to as a "head") 20 for printing is placed. At the printing position A, the medium 10 is almost horizontal and the head 20 is placed above the top surface of the medium 10.

Note that, on the upstream side of the printing position A, a feed roller 12 for feeding the medium 10 in the feed direction is provided. The feed roller 12 is rotationally driven to feed the medium 10 in the feed direction.

A platen 16 is placed under the medium 10 at the printing position A. The platen 16 includes an ink receiver 18 that is formed concave downward. The ink receiver 18 is a container-like portion formed to receive the bleed-through ink, when the ink hitting the top surface of the medium 10 bleeds through.

And, the platen 16 further includes an end edge portion 22 formed on the top end of the wall surface on the downstream side of the ink receiver 18, so that the end edge portion 22 is in contact with the bottom surface of the medium 10. Specifically, the medium 10 is pulled from the end edge portion 22 toward the bottom of the figure and loaded with a tension. Thus, by forming the end edge portion 22, a predetermined tension can be given to the medium 10 at the printing position A in conjunction with a tension given by a blower described later.

At a predetermined position adjacent to and on the downstream side of the printing position A, a blower 26 for applying an air flow to the bottom surface of the medium 10 with the top surface hit by ink is provided.

The blower 26 may be in any form as far as it is placed under the medium 10 and can send an air flow to the medium 10.

Preferably, the blower 26 is a variable air-flow amount type blower in which the amount of air flow can be adjusted. Specifically, the amount of air flow of the blower 26 can be preferably adjusted by controlling the number of revolutions of the motor for driving the blower 26.

Furthermore, a heater may be provided to the blower 26 in order to send a heated air flow (hot air flow). With the heater placed on the air inlet side of the blower 26, the blower 26 can take in an air heated by the heater and send the air flow. Preferably, the heating temperature of the heater can be adjusted. With the adjustable heating temperature, the blower 26 can send an air flow at a temperature appropriate for the air temperature and ink type, thereby controlling the temperature of the ink so that the temperature of the ink will not exceed the sublimation temperature and the reaction temperature.

The heater that can send a heated air flow can dry the bleed-through ink more rapidly.

Note that, when the air temperature is so high that a heated air flow is not required, the heater may be switched off to send a non-heated air flow.

Note that, a cover 28 in which a plurality of ventilating holes 29, 29, . . . , 29 are formed is placed between the upper portion of the blower 26 and the bottom surface of the medium 10. Without the cover 28, an air flow from the blower 26 is concentrated to one point of the medium 10, which may cause non-uniformity in drying the bleed-through ink or instability in the tension loaded on the medium 10. Then, with the cover 28, an air flow from the blower 26 is distributed over the plurality of ventilating holes 29, so the media 10 is uniformly applied with the air flow.

Figure 2:
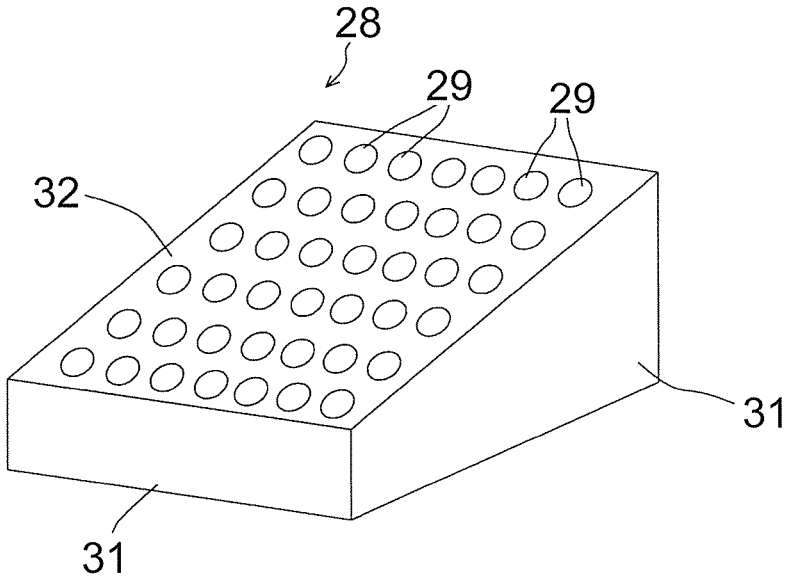
FIG. 2 is a view illustrating a cover.

FIG. 2 shows an example of the cover 28.

The cover 28 is placed over the blower 26 and enclosed by a plurality of side panels 31, so that an air flow from the blower 26 will not escape to the outside, and a top panel 32 in which a plurality of ventilating holes 29, 29, . . . , 29 are formed is placed on the top. The top panel 32 is formed along and in parallel to the bottom surface of the medium 10. In the embodiment, since the medium 10 gradually declines in the feed direction, the top panel 32 has a tilt angle corresponding to the tilt angle of the medium 10.

The ventilating holes 29 may typically have a circular cross section, but the cross section is not limited to be circular and may be elliptical or elongated.

Also, the ventilating holes 29 may be smaller in size and more closely spaced than those shown in FIG. 2.

As shown in FIG. 1, the medium 10 with the bleed-through ink dried by an air flow from below sent by the blower 26 is put onto a tensioning bar 30 positioned at a lower level on the downstream side of the feed direction and is given a predetermined tension by the tensioning bar 30.

Then, the medium 10 is wound by a wind roll 34 through the tensioning bar 30.

As described above, since the blower 26 is provided adjacent to the printing position A, the medium 10 at the printing position A is reliably given the tension, which can prevent the slack of the medium. This maintains constant the position (level) at which the ink hits the medium, which can prevent distortion of printing at the printing position A to enhance the printed image quality and prevent misalignment, non-uniformity and the like of the medium. Furthermore, the contact pressure of the medium 10 onto the end edge portion 22 on the downstream side of the ink receiver 18 of the platen 16 can be reduced, which can suppress the occurrence of contamination and prevent the wearing of the end edge portion 22.

Furthermore, the cover 28 in which the plurality of ventilating holes 29, 29, . . . , 29 are formed allows the medium to be uniformly applied with an air flow from the blower 26. This provides uniformity in the tension on the medium.

Furthermore, the blower 26 provided with the heater can apply a heated air flow to the bottom surface of the medium 10, allowing the bleed-through ink to be more rapidly dried. Preferably, the heating temperature of the heater can be adjusted.

Furthermore, the platen 16 includes: the ink receiver 18; and the end edge portion 22 disposed on the downstream side of the ink receiver 18 so that the medium 10 is contact with the end edge portion 22. This allowing the contact pressure at which the medium 10 is in contact with the end edge portion 22 of the ink receiver 18 to be reduced, thereby causing the contact pressure of the medium 10 to be reduced, which can suppress the occurrence of contamination and prevent the wearing of the end edge portion 22.

Furthermore, since the amount of air flow from the blower 26 can be adjusted, the drying condition and the tension can be changed depending on the type of the medium 10, so an optimum printing condition can be chosen.

The invention claimed is:

1. An inkjet printing apparatus, comprising:

an inkjet head, for discharging an ink onto a mesh-like medium which has through holes penetrating from a top surface to a bottom surface, and the top surface is a printing surface, and the mesh-like medium is a fabric;

a feeder, for feeding the mesh-like medium in a feed direction; and a dryer, for drying the mesh-like medium hit by the ink discharged from the inkjet head, wherein the dryer has a blower placed under the mesh-like medium, the blower is for applying an air flow to the bottom surface of the mesh-like medium with the top surface hit by the ink, wherein the mesh-like medium pulled out from a pull roll is given a predetermined tension by a first tensioning bar, and the mesh-like medium is horizontal at a printing position, the dried mesh-like medium is also given the predetermined tension by a second tensioning bar and is wound by a wind roll, and the blower is provided adjacent to and on a downstream side of the printing position at which the inkjet head is placed, and the mesh-like medium is also applied with the predetermined tension by the air flow sent form the blower.

2. The inkjet printing apparatus according to claim 1, further comprising:

a cover, in which a plurality of ventilating holes are formed, is provided between the blower and the mesh-like medium.

3. The inkjet printing apparatus according to claim 1, further comprising:

a heater, is provided in the blower so that the blower sends a heated air flow.

4. The inkjet printing apparatus according to claim 1, further comprising:

a platen, is provided under the printing position at which the inkjet head is placed, and the platen includes:

an ink receiver, being formed concave downward so as to receive the ink which has bled through the mesh-like medium; and an end edge portion, being formed on the top end on the downstream side of the ink receiver, so that the end edge portion is in contact with the bottom surface of the mesh-like medium.

5. The inkjet printing apparatus according to claim 1, wherein the amount of the air flow from the blower is adjusted.

6. The inkjet printing apparatus according to claim 1, further comprising:

a cover, in which a plurality of ventilating holes are formed, is provided between the blower and the mesh-like medium.

* * * * *